US012110759B2

(12) United States Patent
Marques Pires et al.

(10) Patent No.: US 12,110,759 B2
(45) Date of Patent: Oct. 8, 2024

(54) EQUIPMENT FOR SELF-ABANDONMENT OF WELLS

(71) Applicant: Petróleo Brasileiro S.A.—Petrobras, Rio de Janeiro (BR)

(72) Inventors: Luis Carlos Marques Pires, Rio de Janeiro (BR); Danilo Colombo, Rio de Janeiro (BR)

(73) Assignee: Petróleo Brasileiro S.A.—Petrobras, Rio de Janeiro (BR)

( * ) Notice: Subject to any disclaimer, the term of this patent is extended or adjusted under 35 U.S.C. 154(b) by 0 days.

(21) Appl. No.: 18/077,554

(22) Filed: Dec. 8, 2022

(65) Prior Publication Data

US 2023/0184054 A1 Jun. 15, 2023

(30) Foreign Application Priority Data

Dec. 9, 2021 (BR) ..... 10 2021 024965 0

(51) Int. Cl.
*E21B 33/13* (2006.01)
*E21B 47/12* (2012.01)

(52) U.S. Cl.
CPC ..... *E21B 33/13* (2013.01); *E21B 47/12* (2013.01)

(58) Field of Classification Search
CPC ..... E21B 29/02; E21B 33/1208; E21B 33/13; E21B 47/12
See application file for complete search history.

(56) References Cited

U.S. PATENT DOCUMENTS

| | | | | |
|---|---|---|---|---|
| 10,883,329 | B2 | 1/2021 | Tøndel et al. | |
| 10,941,630 | B2 | 3/2021 | Carragher | |
| 2006/0037748 | A1* | 2/2006 | Wardlaw | E21B 36/008 166/387 |
| 2016/0145962 | A1* | 5/2016 | Carragher | C06B 47/00 166/57 |
| 2018/0313193 | A1* | 11/2018 | Gibb | E21B 7/20 |
| 2018/0371859 | A1* | 12/2018 | Tøndel | E21B 33/13 |
| 2019/0032440 | A1 | 1/2019 | Tøndel et al. | |

* cited by examiner

*Primary Examiner* — Caroline N Butcher
(74) *Attorney, Agent, or Firm* — Mintz, Levin, Cohn, Ferris, Glovsky, and Popeo, P.C.

(57) ABSTRACT

Equipment for autonomous abandonment of wells is installed its position during the completion of the well. Such equipment melts the string, cables and accessories and the casing by means of an exothermic reaction (which may have thermite among its reagents). The start of this reaction is remotely triggered according to the interest of the well operator. As a product of the process, there is the formation of a permanent barrier (BIS) to abandon the well. This permanent barrier will be a product of the residual material from the heat release reaction, a molten material from the string and casing, as well as the material responsible for the formation of the BIS, which shall have eutectic characteristics, that is, after its solidification it shall have an expansion in order to ensure that it generates rock-to-rock adhesion.

7 Claims, 5 Drawing Sheets

EQUIPMENT FOR SELF-ABANDONMENT OF WELLS

CROSS-REFERENCE TO RELATED APPLICATION

This application claims priority to Brazilian Application No. 10 2021 024965 0, filed on Dec. 9, 2021, and entitled "EQUIPMENT FOR SELF-ABANDONMENT OF WELLS," the disclosure of which is incorporated herein by reference in its entirety.

FIELD OF THE INVENTION

The present invention addresses to an equipment for use in the well completion step, which has a monitoring system, and its activation is done remotely when the well is abandoned, in order to reduce operating costs.

DESCRIPTION OF THE STATE OF THE ART

The abandonment of offshore wells is an activity that has become a major challenge for the Oil and Gas (O&G) industry, mainly because of the intrinsic costs due to the need of using rigs, which are the same used for drilling wells, with high daily costs, in addition to operational and abandonment management costs.

The well abandonment process is carried out through the following steps: DMM—Demobilization, Movement and Mobilization of the drilling platform, which is a semi-submersible rig (SS) or drillship (DS), preparation and descent of the tool installation of the WCT (TRF—Tree Running Tool), removal of the Tree Cap, access and verification of the well, drilling of the string (Tubing Punch), dampening and cleaning of the well, installation of temporary BIS elements, dissociation of hydrate and cleaning of flow fine, removal of the WCT, preparation and running in of the drilling BOP, preparation and running in of the TH tool (Tubing Hanger Running Tool), removal of the string, installation and verification of the permanent BISs elements, and removal of the drilling BOP.

New technologies for abandonment, such as thermite milling, plasma milling and PWC-TT (Perforate, Wash and Cement tool through the production/injection string (through-tubing)), are expected to reduce abandonment time by 9 days on average.

Document US20190032440A1 refers to a well operation tool and a method of preventing entry into the well operation tool. The well operation tool can be used in a pressurized environment (above 1 atmospheric pressure). There is a need for intervention through the use of rig and other equipment for the abandonment of the well.

Document U.S. Pat. No. 10,883,329B2 refers to an electrical igniter, a system comprising an electrical igniter, and a method of electrically igniting an exothermic mixture. The exothermic mixture can, for example, be disposed in a well (wellbore) for obturation (plugging) and for abandoning (plugging and abandoning—P&A) of a well by melting the surrounding materials. In that document, it is mentioned that the electric ignitor is run in the well at the time of abandonment.

Document U.S. Pat. No. 10,941,630B2 discloses a plug tool, a method for abandoning a well, and a method for tailoring a well abandonment system to suit an underground conduit or well. Such a document mentions heating mixtures using a combination of basic thermite (e.g., aluminum and iron oxide powder) and a combustion suppressant or damping agent such as silica, for example. Thermite is used as an energy source for melting bismuth, the metallic material that makes up the BIS.

It is observed that the present invention differs from the State of the Art presented herein not regarding the use of thermite as an energetic material used for fusion of the production string and accessory materials (flatpacks, clamps, etc.), but by the method of employment of this material and for dispensing with the use of marine rigs to abandon the well.

For the cases presented, the thermite is positioned at the bottom of the well, at the end of its life cycle, either by pumping or displacement of the material, requiring the use of rigs during the string removal procedure. After this procedure, it is also necessary to use materials to form the BIS (barrier integrated set). Currently, the material used to form BIS is cement.

In the present invention, instead of the thermite being positioned at the end of the life cycle of the well, it is positioned in the construction of the well, and remains resident throughout its productive life, without the need of using rigs for abandonment.

Another aspect of this invention is that in the same SUB (segment of string in which the thermite is found) there is a segment containing an alloy of metallic material (a bismuth alloy) that, when solidified, expands. This material is being tested as a substitute for cement as BIS.

The invention has a self-monitoring resident ignition system with remote activation, which is run in the well at the time of its completion.

In this way, the use of the abandonment SUB is innovative, since, instead of having the use of materials already developed and registered at the end of the life cycle of the well, requiring the use of rigs for abandonment and with this high ABEX cost (cost of abandonment), the abandonment SUB is installed in the production string in its construction, and the ignition is done remotely directly from the Stationary Production Unit (SPU). Therefore, the ABEX costs of the well with rig are zeroed.

Thus, none of the documents of the State of the Art discloses equipment for self-abandonment of wells such as the one of the present invention.

In short, the present invention presents advantages of applying the thermite installed at the time of construction of the well and resident throughout its productive life, and not after the productive life of the well for its abandonment. Further, the system is integrated into the completion itself, demanding that it already be carried out with the proposed technology; that is, a sub with energetic material, ignitors and sensors. The works verified in the State of the Art are applicable for conventional completions and if there are access restrictions (drift).

BRIEF DESCRIPTION OF THE INVENTION

The present invention addresses to an equipment for autonomous abandonment of wells, in which this equipment is a "SUB" (completion equipment integrated into the production or injection string) containing energetic material, such as thermite, responsible for emitting heat until reaching a temperature sufficient for melting the materials in the production or injection string, as well as the casing. Above the energetic material, there is a unit containing a sealing material (which can be a bismuth alloy) that will be incorporated by the molten mass and together they will form the abandonment plug (element of the BIS (barrier integrated set)). Among the functions of the sealing material is to compensate for eventual volumetric contractions of the molten material after cooling, ensuring that there will be no formation of leakage channels.

The equipment of the present invention is part of the completion of the well, having a monitoring system and its activation is done remotely when the well is abandoned.

BRIEF DESCRIPTION OF THE DRAWINGS

The present invention will be described in more detail below, with reference to the attached figures which, in a schematic and non-limiting way of the inventive scope, represent examples of its embodiment. In the drawings, there are.

DETAILED DESCRIPTION OF THE INVENTION

Figure 1:
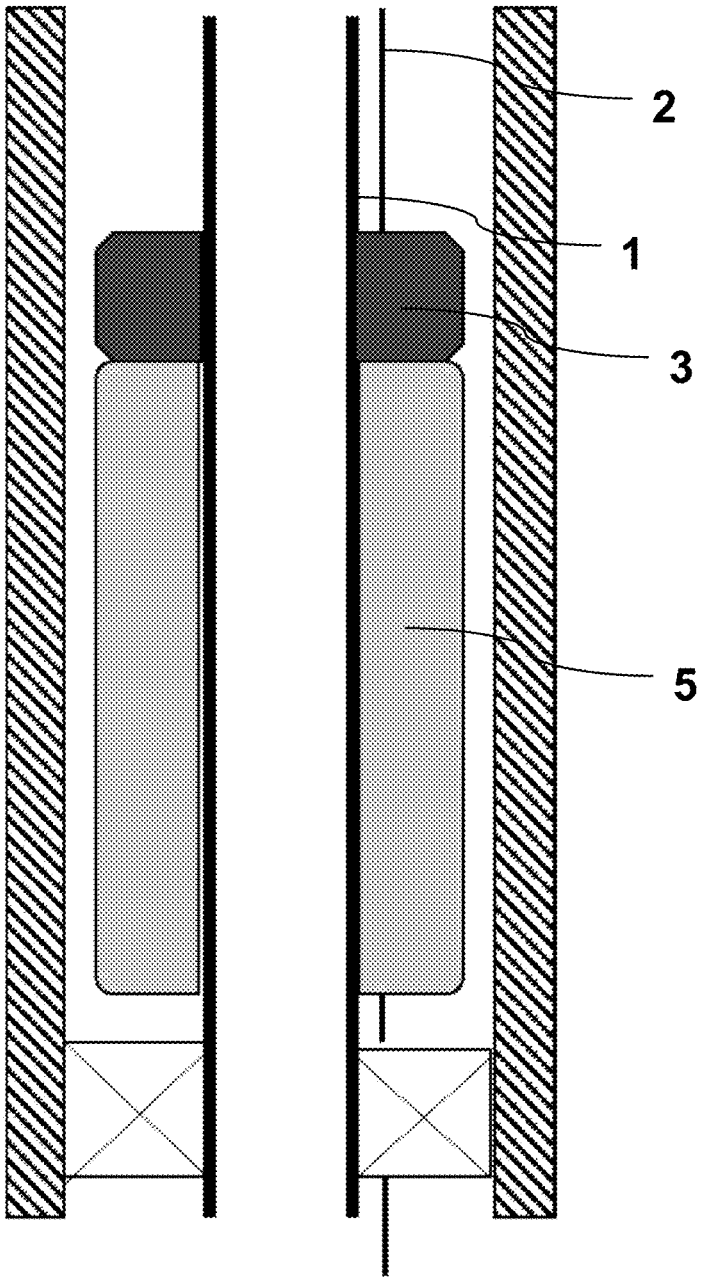
FIG. 1 illustrating the SUB installed and in operation before abandonment.
Figure 2:
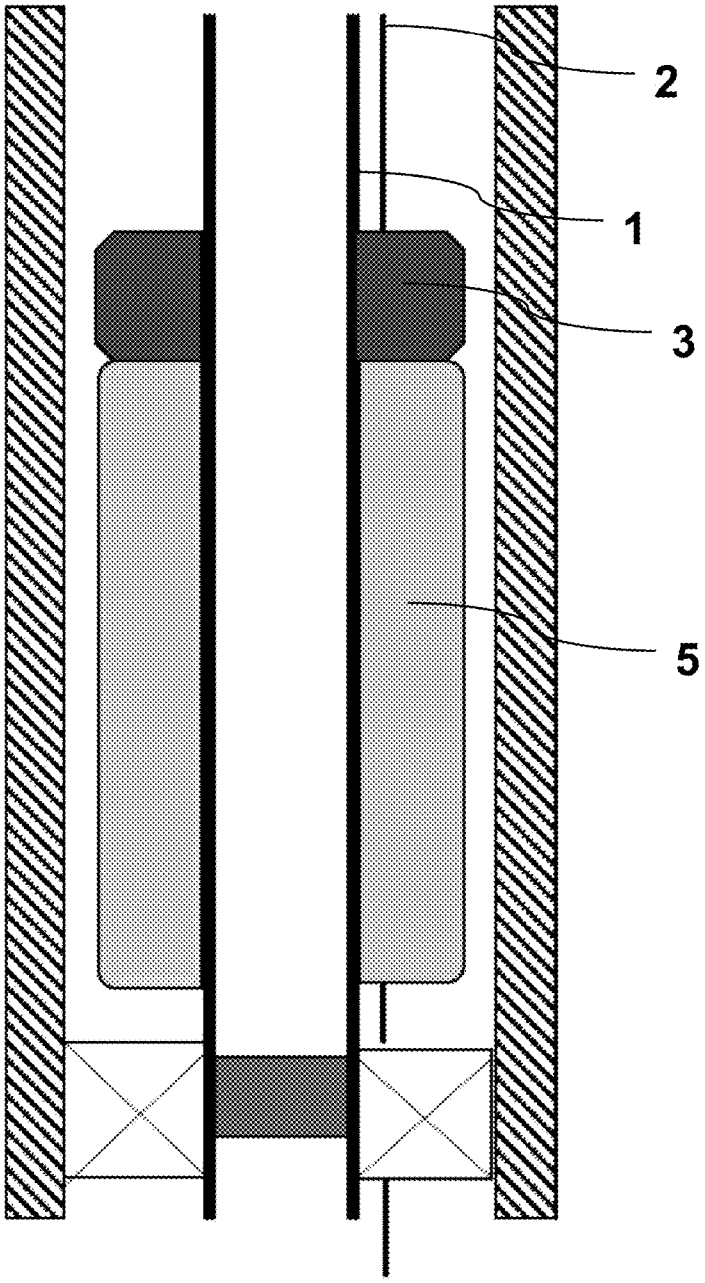
FIG. 2 illustrating the SUB with the check-valve (gray box) or an installed CAP (equipment that closes a segment of the well. It serves to prevent the molten energetic material from flowing into the lower segments of the string.)
Figure 3:
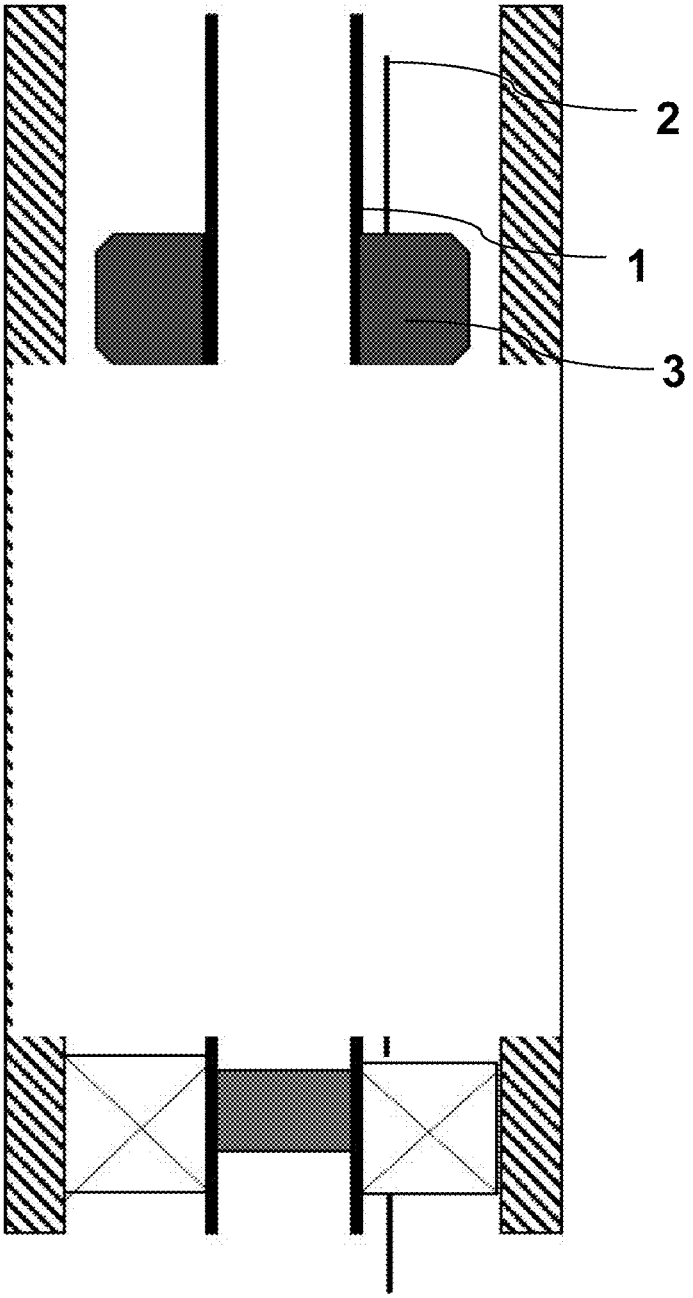
FIG. 3 illustrating the result after the exothermic reaction that melts the material contained in the string, casing and accessories.
Figure 4:
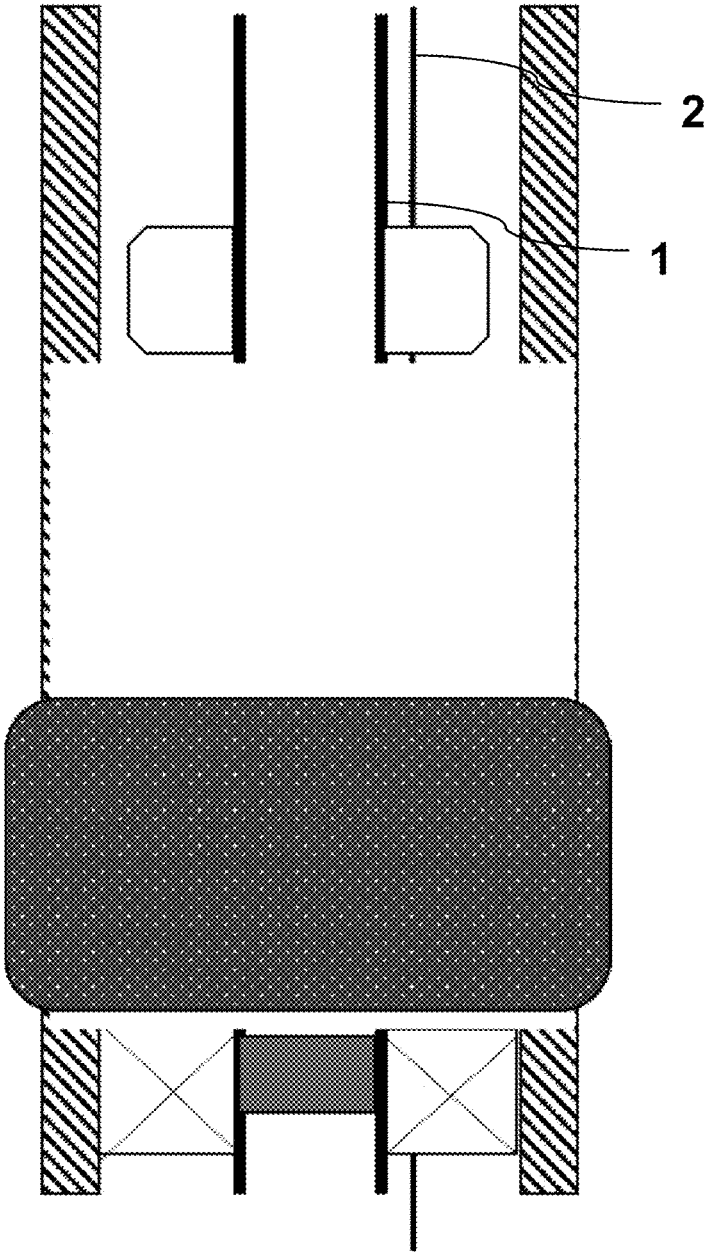
FIG. 4 illustrating the BIS, formed by the material resulting from the fusion of the string, casings and accessories, and by the sealing material which, due to its characteristics, expands forming a rock-rock seal.
Figure 5:
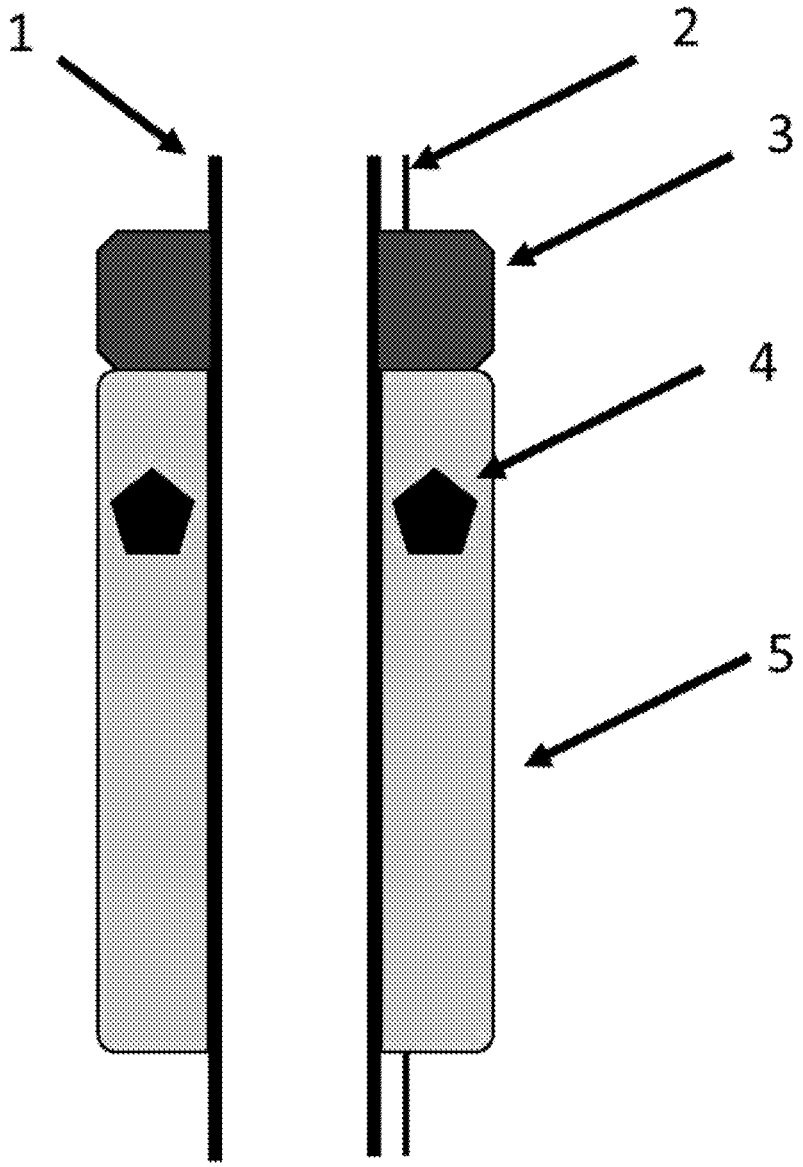
FIG. 5 illustrating a schematic drawing of the equipment of the present invention, SUB, where there are represented the internal casing (1), data and power cables (2), the permanent barrier casing case (3), the reaction initiator (4), and the energetic material case (5).

The self-abandonment equipment, according to the present invention and illustrated in FIG. 5, comprises an internal casing (1)—wall of the same diameter and technical specification of the production or injection string; data and power cables (2) with passage, to be installed internally to the equipment or externally to the same; a permanent barrier casing case (3)—solid material with a low melting point (aluminum and its alloys, bismuth and its alloys, for example), which, after solidification, expands; a reaction initiator (4), which can be chemical, by electric spark or other heat source that is sufficient to start the reaction in the energetic material case (5). The energetic material case (5) is composed, for example, of thermite which, after starting the reaction, releases enough energy to melt the string and the casing of the well.

Details of application of the invention are shown in FIGS. 1 to 4. The equipment object of the present invention is a SUB installed during the completion of the well, which is made up in two stages: a stage containing energetic material (5), responsible for the milling of the production string, production casing, and a second stage with sealing material (3), which forms the BIS (barrier integrated set), responsible for leak-tightness for permanent abandonment.

The reaction is initiated by the reaction initiator (4), which can be an electric arc, a chemical reaction, or another heat source that allows reaching the activation energy of the exothermic reaction. The heat generated by the energetic stage reaction (5) is responsible for melting the production string and the casing, leaving the rock visible. In addition, it is also responsible for melting the material contained in the sealing material stage (3).

After thermal removal of the string, lines, accessories and casing, the sealing material is deposited on the by-product material of the removal which, after cooling, will undergo expansion, due to its unique characteristics of eutectic mixture, forming a uniform barrier rock-to-rock.

The installation of the SUB is carried out when the well is completed, and it can be, for example, threaded to the other segments of the string.

The initiator is installed along with the SUB. Its activation is done by an electric current that initiates the reaction of the energetic material, or another parallel reaction that reaches the activation energy of the energetic material. The reaction of this material is a redox reaction and only occurs in the liquid phase. For its components to liquefy, it is necessary to reach the melting temperature (something around 700° C., depending on the mixture). The activation can be done by electric-arc, black powder, nitrocellulose, or electric detonators.

The temperature is a function of the aluminothermy reaction, which reaches an average of 2500° C., when using III iron oxide together with aluminum. Other mixtures are also possible using copper and aluminum mixtures, which allows reaching higher temperatures.

The block resulting from the energetic material plus sealant constitutes the BIS of the well, replacing the cement normally used.

It should be noted that, although the present invention has been described in relation to the attached drawings, it may undergo modifications and adaptations by technicians skilled on the subject, depending on the specific situation, but provided that within the inventive scope defined herein.

The invention claimed is:

1. Equipment for self-abandonment of a well, comprising;
- an internal casing having a wall of a same diameter and technical specification as a production string or injection string;
- data and power cables;
- a permanent barrier casing case;
- a reaction initiator along an outer surface of the wall of the internal casing;
- an energetic material case encircling the internal casing and coupled to the reaction initiator; and
- an energetic material housed within the energetic material case.

2. The equipment for self-abandonment of a well according to claim 1, wherein the data and power cables are installed internally or externally to the equipment.

3. The equipment for self-abandonment of a well according to claim 1, wherein the reaction initiator is a chemical reaction, electric spark, or other heat source.

4. The equipment for self-abandonment of a well according to claim 1, wherein the energetic material is thermite.

5. The equipment for self-abandonment of a well according to claim 1, wherein the permanent barrier casing case comprises an aluminum alloy.

6. The equipment for self-abandonment of a well according to claim 1, wherein the permanent barrier casing case comprises a bismuth alloy.

7. The equipment for self-abandonment of a well according to claim 1, wherein the equipment is installed within the well during completion of the well.

* * * * *